United States Patent [19]

Miyahara

[11] Patent Number: 4,529,375

[45] Date of Patent: Jul. 16, 1985

[54] FUEL GASIFYING BURNER

[75] Inventor: Kingo Miyahara, Tokyo, Japan

[73] Assignee: Dowa Co., Ltd., Tokyo, Japan

[21] Appl. No.: 620,550

[22] Filed: Jun. 18, 1984

Related U.S. Application Data

[63] Continuation of Ser. No. 365,428, Apr. 5, 1982, abandoned.

[51] Int. Cl.[3] ..... F23D 11/44

[52] U.S. Cl. ..... 431/210; 431/232; 431/236; 431/247

[58] Field of Search ..... 431/210, 220, 232, 233, 431/234, 235, 236, 238, 244, 247, 248

[56] References Cited

U.S. PATENT DOCUMENTS

| | | | |
|---|---|---|---|
| 679,245 | 7/1901 | Slinack | 431/232 |
| 1,003,180 | 9/1911 | Hall | 431/244 |
| 1,353,010 | 9/1920 | Yeager | 431/232 |
| 1,526,227 | 2/1925 | Lauster | 431/232 |
| 1,533,081 | 4/1925 | Adcock | 431/232 |
| 1,988,334 | 1/1935 | Risinger | 431/210 |
| 2,041,145 | 5/1936 | Pickup | 431/232 |
| 2,136,727 | 11/1938 | Pirich | 431/210 |
| 2,256,305 | 9/1941 | Yeager | 431/232 |
| 2,556,482 | 6/1951 | Nissinen | 431/248 X |
| 2,661,054 | 12/1953 | Hyatt et al. | 431/232 X |

FOREIGN PATENT DOCUMENTS

| | | | |
|---|---|---|---|
| 1076977 | 4/1954 | France | 431/244 |

*Primary Examiner*—Randall L. Green

*Attorney, Agent, or Firm*—Pollock, Vande Sande & Priddy

[57] ABSTRACT

A fuel gasifying burner including a combustion device located below a portion of a gas generating member housing a fuel supply device for directing a supply of liquid fuel into the interior of the gas generating member. A plurality of combustion members formed with flame apertures at their surfaces are arranged on either side of the gas generating member substantially in the same horizontal plane or in a plane below that of the gas generating member and maintained in communication with the gas generating member. The combustion members may be one in number and annular in form and located below the gas generating member or of a torus shape to allow the gas generating member to extend through its center opening. Actuation of the combustion device first allows the gas generating member and combustion members to be preheated to a fuel gasifiable temperature by flames of combustion of liquid fuel and then permits gas generating member to be heated by flames formed by combustion of gasified fuel ejected through the flame apertures of the combustion members.

9 Claims, 8 Drawing Figures

FUEL GASIFYING BURNER

This application is a continuation of application Ser. No. 365,428, filed Apr. 5, 1982, now abandoned.

TECHNICAL FIELD

This invention relates to a fuel gasifying burner capable of quickly changing a supply of liquid fuel to a gaseous state so that gasification of the supply of liquid fuel and combustion thereof by forming a mixture with air can be carried out continuously over a prolonged period of time.

DISCLOSURE OF THE INVENTION

This invention has as its object the provision of a fuel gasifying burner of novel construction enabling combustion of liquid fuel in the form of gasified fuel to be initiated quickly at early stages of burner operation and smoothly continued thereafter during the entire period of burner operation.

The outstanding characteristic of the invention is that the liquid fuel gasifying burner comprises a gas generating member, at least one combustion member, fuel supply means mounted in the gas generating member and combustion means located below a portion of the gas generating member in which the fuel supply means is located to preheat the gas generating member and the combustion member from outside, whereby the gas generating member and the combustion member can be quickly preheated without causing combustion loss thereto. Preheating of the gas generating member and the combustion member can be quickly achieved with flames of combustion of liquid fuel in good condition, so that combustion of the liquid fuel in a gasified state can be started at early stages of burner operation and continuously carried out over a prolonged period of time in a satisfactory condition.

BRIEF DESCRIPTION OF THE DRAWING

Additional and other objects, features and advantages of the invention will be apparent from the description set forth hereinafter when considered in conjunction with the accompanying drawings, in which.

BEST MODE FOR CARRYING OUT THE INVENTION

Preferred embodiments of the invention will now be described by referring to the accompanying drawings.

Figure 1:
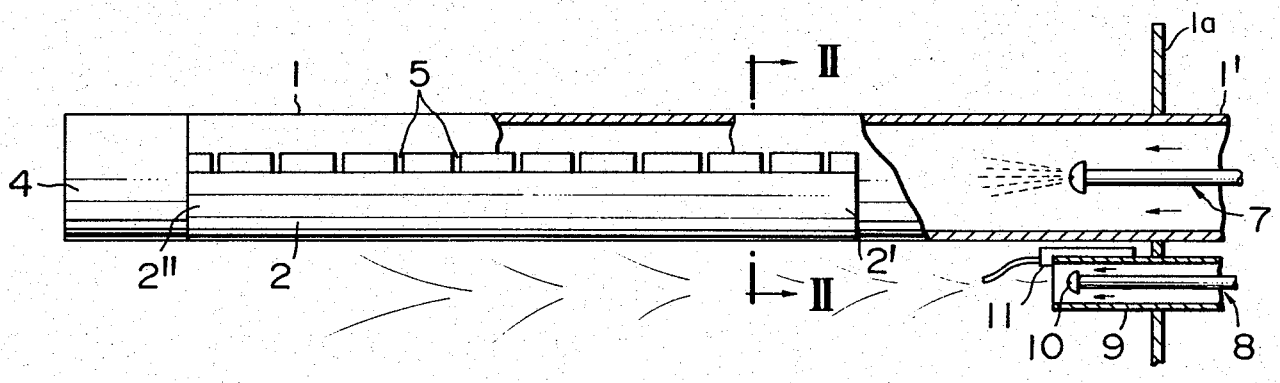
FIG. 1 is a side view of the fuel gasifying burner comprising a first embodiment of the invention, with certain parts being broken away.
Figure 2:
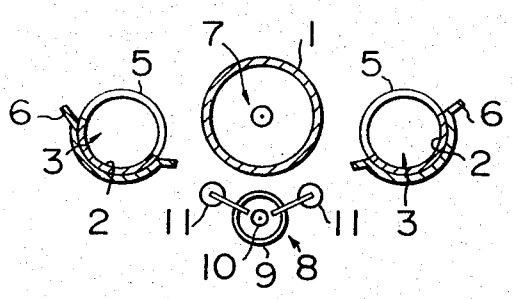
FIG. 2 is a sectional view taken along the line II—II in FIG. 1.
Figure 3:
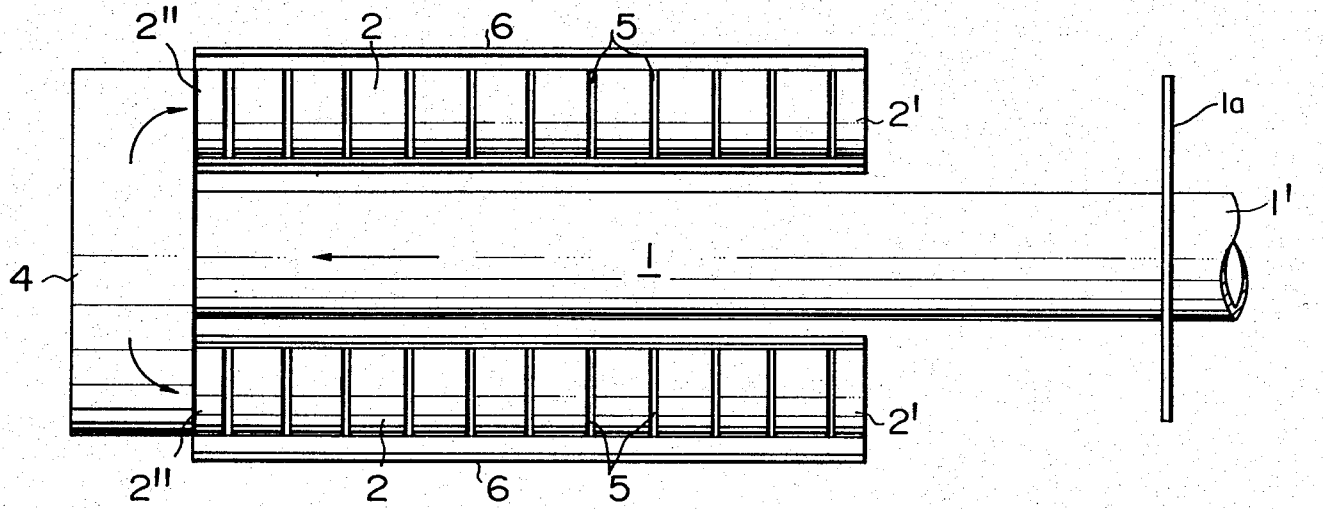
FIG. 3 is a plan view of the fuel gasifying burner shown in FIG. 1.

In FIGS. 1–3, an elongated tubular gas generating member 1 is connected at its base to a support 1*a*. The interior of member 1 receives a flow of air from an air blowing cylinder, not shown. At least one and preferably a plurality of combustion members 2 of elongated cylindrical or tubular shape to enable a mixture of gasified fuel and air to burn in a gasified state are each arranged on either side of the gas generating member 1 in spaced apart relation in substantially the same horizontal plane. The elongated combustion members 2 are closed at their forward ends 2' to provide a gas chamber 3 in each of the combustion members 2 and connected at their bases 2'' to a communicating member or manifold 4 which in turn is connected to a forward end of the gas generating member 1. The combustion members 2 are formed with a multiplicity of slit-like flame apertures 5 on the upper half surface portion and the portion thereof facing the gas generating member 1 and have flame directing plates 6 attached to the outer peripheral portion thereof having no flame apertures 5. The flame directing plates 6 each include projections extending upwardly and downwardly for directing the flames toward the gas generating member 1 in a stable fashion.

The flame apertures 5 of the combustion members 2 may be of any suitable form other than the slits, such as small circular apertures. The numeral 7 designates fuel supply means housed inside the gas generating member 1 at the base thereof. In the embodiment shown and described herein, the fuel supply means 7 ejects fuel in atomized particles through a nozzle at its forward end. However, the invention is not limited to this specific manner of fuel supply and the fuel supply means 7 may merely have an opening at its forward end to allow the liquid fuel to be fed in droplets into the interior of the gas generating member 1. The numeral 8 designates start-up combustion means located beneath a portion of the gas generating member 1 in which the fuel supply means 7 is housed and comprising an air feeding line 9 for supplying combustion air, a nozzle 10 for supplying a spray of liquid fuel, and an ignition plug 11 for starting combustion. The combustion means 8 is operative to obtain combustion of both liquid fuel and gaseous fuel.

Figure 4:
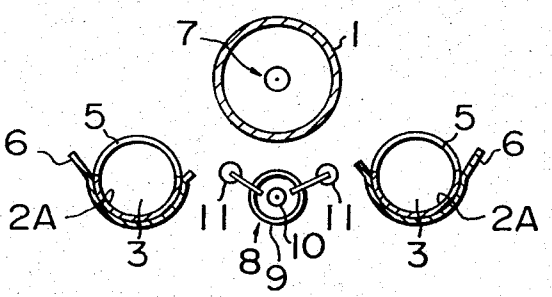
FIG. 4 is a vertical sectional front view of the fuel gasifying burner comprising a second embodiment.

In the first embodiment shown in FIGS. 1 and 2, the elongated combustion members 2 are arranged on both sides of the gas generating member 1 substantially in the same horizontal plane. The invention is not limited to this specific arrangement of the members 1 and 2 and the elongated combustion members 2 may be located, as shown in FIG. 4 as a second embodiment, in positions obliquely downwardly of the gas generating member 1 on both sides thereof as indicated at 2A. In the second embodiment, the combustion means 8 is interposed between the combustion members 2A to enable better preheating effects to be achieved.

Figure 5:
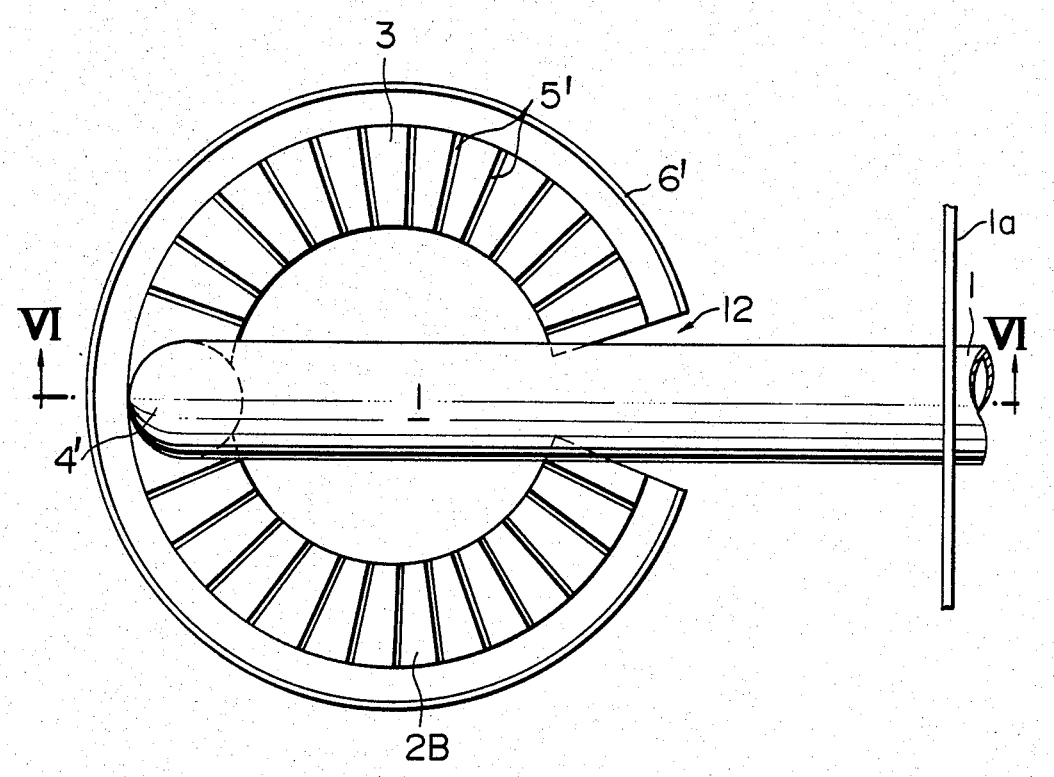
FIG. 5 is a plan view, with certain parts being cut out, of the fuel gasifying burner comprising a third another embodiment.
Figure 6:
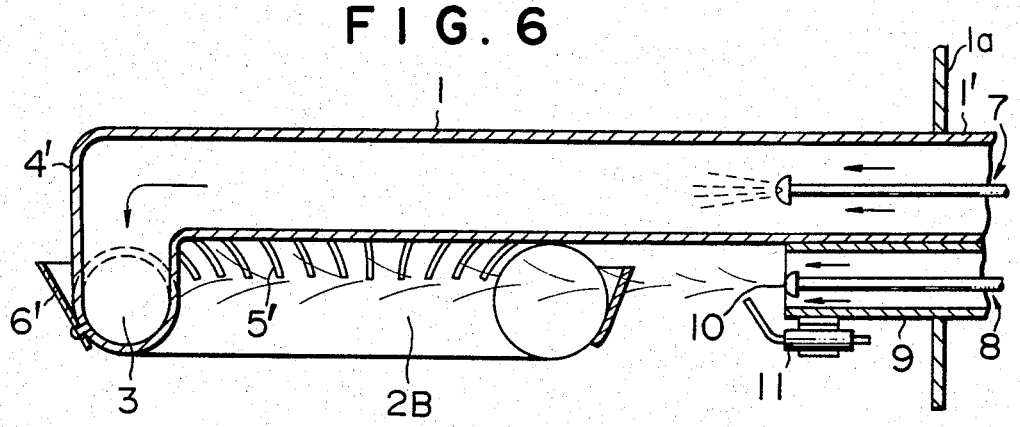
FIG. 6 is a sectional view taken along the line VI—VI in FIG. 5.

FIGS. 5 and 6 show a third embodiment in which the single combustion member 2B is arranged in annular form as seen in a plan view and maintained in communication with the forward end of the gas generating member 1 as its lower portion, so that the flames of combustion for obtaining fuel gasification can be directed upwardly from below. In this embodiment, to enable preheating of the gas generating member 1 and combustion member 2B as a whole to be efficiently achieved with the flames of combustion of liquid fuel carried out by the combustion means 8, a cutout flame passage 12 is formed in a portion of the combustion member 2B located on the side of the base 1' of the gas generating member 1 positioned opposite the combustion means 8 to allow the flames of combustion of the liquid fuel to extend therethrough. The annular combustion member 2B is formed at its upper half portion with flame apertures 5′ and has a flame directing plate 6′ arranged at the outer circumference thereof.

Figure 7:
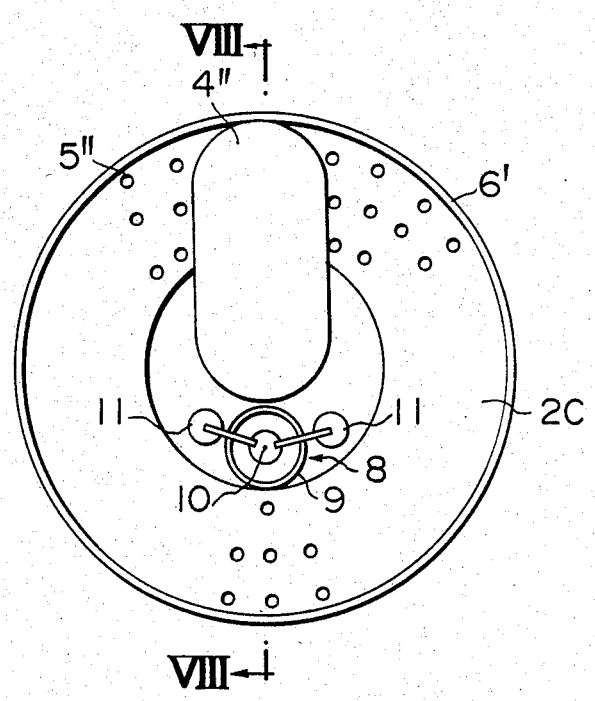
FIG. 7 is a front view of the fuel gasifying burner comprising a fourth embodiment.
Figure 8:
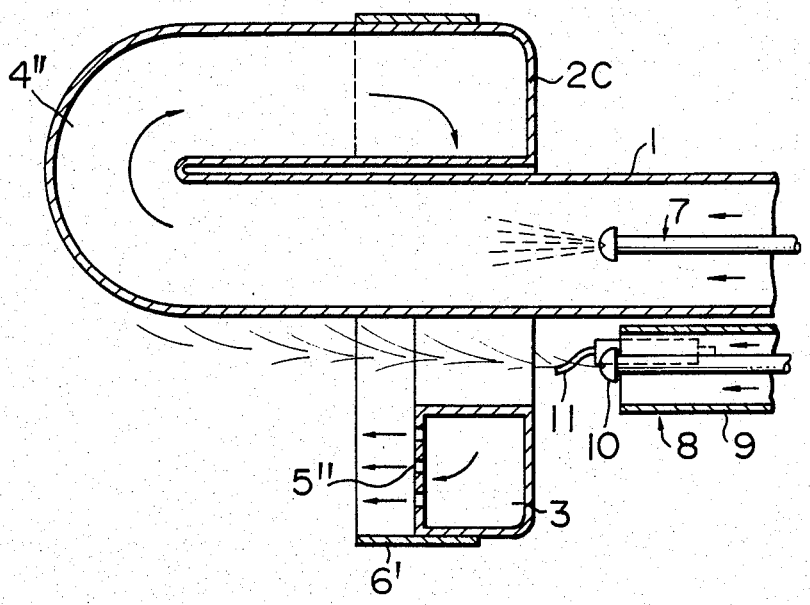
FIG. 8 is a sectional view taken along the line VIII—VIII in FIG. 7.

FIGS. 7 and 8 show a fourth embodiment in which the single combustion member 2C is in the form a torus to allow the flames of combustion to obtain gasification of the fuel to be directed forwardly. The torus-shaped combustion member 2C is arranged on its side with the central axis of the torus essentially horizontal, so that the gas generating member 1 located horizontally may extend substantially through the center opening of the combustion member 2C. In this embodiment, the gas generating member 1 is maintained in communication with the combustion member 2C through a communicating member 4″, and the combustion member 2C is formed with a multiplicity of flame apertures 5″ at its surface. Combustion means 8 is positioned below gas generating member 1 and opposite the center opening of the torus-shaped combustion member 2C.

Operation of the fuel gasifying burner according to the invention will be described. When it is desired to obtain combustion of liquid fuel in gasified form by the fuel gasifying burner shown in FIGS. 1–3, air for combustion is forcedly fed in the direction of arrows through the air feeding line 9 and at the same time fuel is ejected in atomized particles through the nozzle 10. A current is passed to the ignition plug 11 to actuate the combustion means 8. Actuation of the combustion means 8 enables complete combustion of the fuel to be achieved to produce flames by the combustion of the liquid fuel which preheats the gas generating member 1 and the combustion members 2 from outside. Thus the members 1 and 2 can be heated in a short period of time to a temperature high enough to obtain gasification of the liquid fuel. When the gas generating member 1 and combustion members 2 are preheated to a liquid fuel gasifiable atmosphere temperature, a supply of liquid fuel is fed to the base end 1′ of the gas generating member 1 and at the same time the air for combustion is fed in jet streams in the direction of arrows. While flowing through the preheated gas generating member 1, the supply of liquid fuel and the combustion air are quickly gasified and mixed with each other following agitation to form a fuel-air mixture which flows through the communicating member 4 into the combustion members 2. After being thus forced into the combustion members 2 and staying therein for an instant, the fuel-air mixture is ejected in jets through the flame apertures 5 under a predetermined pressure and ignited by the flames of combustion of the liquid fuel from the combustion means 8 to form flames of combustion of the gaseous fuel. Thus the fuel burns in gasified form and heats the gas generating member 1 from outside. When heating of the gas generating member 1 can thus be carried out by the flames of combustion of the liquid fuel in gasified form, heating of the gas generating member 1 can be efficiently achieved with the flames of combustion of the fuel in gasified form even if the combustion means 8 is de-actuated. Thus the fuel-air mixture can be obtained in volumes large enough to enable combustion of the fuel in gasified form to be continuously carried out in good condition, so long as the supply of liquid fuel by the fuel supply means 7 and the ejection of the air for combustion through the air feeding line 9 are not interrupted.

Like the first embodiment shown in FIGS. 1–3, the second, third and fourth embodiments shown in FIGS. 4–7 operate to efficiently generate a mixture of gasified fuel with air by preheating the gas generating member with the flames of combustion of the liquid fuel directed either upwardly or forwardly.

From the foregoing description, it will be appreciated that the fuel gasifying burner according to the invention is provided with combustion means 8 located below a portion of the gas generating member 1 and combustion members 2, 2A, 2B and 2C. By virtue of this constructional feature, it is possible to quickly preheat the gas generating member and the combustion members to a fuel gasifiable temperature to initiate combustion of the fuel in gasified form at early stages of burner operation while avoiding the production and deposition of soot due to incomplete fuel combustion in the gas generating member and combustion members, no matter how often the operating of burning the liquid fuel to obtain combustion of the fuel in gasified form may be carried out. In addition, the invention enables production of a mixture of gasified fuel with air in a complete form to be carried out in continuous operation and at the same time prevents the gas generating member 1 and combustion member 2, 2A, 2B and 2C from being damaged by the flame of combustion, to enable combustion of the fuel in gasified form to be carried out continuously over a prolonged period of time.

What is claimed is:

1. A fuel gasifying burner comprising:

a hollow gas generating member for allowing a mixture of gasified fuel and air to flow therethrough;

means for directing a flow of air through said gas generating member;

at least one combustion member located adjacent said gas generating member, said combustion member being formed with a gas chamber therein and a multiplicity of flame apertures at its surface; means for flowing said mixture from said gas generating member into said at least one combustion member;

a first liquid fuel supply means comprising a nozzle housed in a portion of said gas generating member for directing a supply of liquid fuel in atomized particles with said flow of air toward the interior of said gas generating member; and combustion means comprising an air feeding line, a second fuel supply means comprising a nozzle and an ignition plug, said combustion means being so located in relation to said gas generating member and said combustion member as to preheat both said members and said means for flowing along their lengths thereof from their outsides to temperatures high enough to obtain and maintain gasification of said atomized particles of liquid fuel and to ignite any gasified fuel and air issuing from said multiplicity of flame apertures, whereby both said gas generating member and said combustion member are preheated to temperatures high enough to obtain said gasification of fuel prior to introduction of liquid fuel into said gas generating member.

2. A fuel gasifying burner according to claim 1, wherein said at least one combustion member is in elongated cylindrical form.

3. A fuel gasifying burner according to claim 1, wherein said at least one combustion member is located in the same horizontal plane beside said gas generating member.

4. A fuel gasifying burner according to claim 1, wherein said at least one combustion member is located in a plane below that of said gas generating member.

5. A fuel gasifying burner according to claim 1, wherein said at least one combustion member is annular in form and arranged beneath said gas generating member, said combustion member being formed with a cutout flame passage at a portion thereof adjacent said combustion means.

6. A fuel gasifying burner according to claim 1, wherein said at least one combustion member is in the form of a torus and said gas generating member is arranged to extend through substantially the center opening of said torus.

7. A fuel gasifying burner according to claim 1, wherein said at least one combustion member is annular in form and is arranged in a plane below that of said gas generating member, said at least one combustion member being formed with a cutout flame passage at a portion thereof adjacent said combustion means; said first, liquid fuel supply means comprises a nozzle for ejecting fuel in atomized particles into air flowing through said gas generating member; and said combustion means preheats both said gas generating member and said at least one combustion member to a temperature high enough to obtain gasification of said liquid fuel.

8. A fuel gasifying burner according to claim 1, wherein said at least one combustion member is in the form of a torus and said gas generating member is arranged to extend substantially through the center opening of said torus; said first, liquid fuel supply means comprises a nozzle for ejecting fuel in atomized particles into air flowing through said gas generating member; and said combustion means preheats both said gas generating member and said at least one combustion member to a temperature high enough to obtain gasification of said liquid fuel.

9. A fuel gasifying burner according to claim 8, wherein said torus has an essentially horizontal axis and said gas generating member extends essentially horizontally through said center opening.

* * * * *